United States Patent [19]

Harris

[11] Patent Number: 4,968,917

[45] Date of Patent: Nov. 6, 1990

[54] ELECTRONIC DIMMER CONTROL FOR VACUUM FLUORESCENT DISPLAY DEVICES

[75] Inventor: Richard B. Harris, Plymouth, Mich.

[73] Assignee: Ford Motor Company, Dearborn, Mich.

[21] Appl. No.: 253,459

[22] Filed: Oct. 5, 1988

[51] Int. Cl.[5] ..... H05B 37/02

[52] U.S. Cl. ..... 315/77; 315/169.1; 315/307

[58] Field of Search ..... 315/77, 169.1, 291, 315/307

[56] References Cited

U.S. PATENT DOCUMENTS 4,029,991 6/1977 Schultz ..... 315/77 X

*Primary Examiner*—Robert J. Pascal

*Attorney, Agent, or Firm*—Paul K. Godwin, Jr.; Clifford L. Sadler

[57] ABSTRACT

Apparatus and method for setting the pulse width modulation duty cycle that drives a vacuum fluorescent display device in response to changes in the setting of a dimmer control rheostat by establishing a constant window of acceptable voltage references that are changed when the setting of the dimmer control rheostat is changed, and by sequentially stepping through a set of discrete voltages whenever the setting of the dimmer control rheostat is changed until one of the discrete voltages is found to lie within the window of reference voltages. A dimmer signal is sent to a display driver circuit that corresponds to the selected discrete voltage lying within the reference window and determines the duty cycle and consequent brightness level for the display device.

12 Claims, 1 Drawing Sheet

ELECTRONIC DIMMER CONTROL FOR VACUUM FLUORESCENT DISPLAY DEVICES

BACKGROUND OF THE INVENTION

1. Field of the Invention

The present invention is directed to the field of intensity control for light emitting display devices and more specifically to the area of providing electronic dimming control of the light intensity produced by vacuum fluorescent displaY (VFD) devices.

2. Background Information

The use of VFD devices in automotive vehicles has been widely adopted as a reliable and efficient means for providing display information in a crisp format suitable for reading in both day and night conditions.

In attempting to control the brightness of such displays, it has long been appreciated that pulse width modulation techniques can be used with satisfactorY results. Pulse width modulation provides for various electrodes of the VFD to be selectively energized at a frequency level higher than that which is visually perceivable but with a duty cycle that is varied to achieve a desired brightness level.

U.S. Pat. No. 4,358,713 illustrates a brightness control circuit for a VFD in which a constant frequency oscillator circuit with a varying duty cycle is controlled by a variable resistor. The variable resistor is set according to the brightness level desired by the operator. The output of the oscillator is fed both to filament lamps and a brightness control circuit for the VFD. The brightness control circuit outputs a signal to the VFD that has a frequency and duty cycle corresponding to that which was also applied to the filament lamps.

U.S. Pat. No. 4,388,558 illustrates a circuit in which a fixed frequency oscillator is used to provide a variable duty ratio to various types of display devices such as filament lamps, VFDs and light emitting diode (LED) display devices. It is appreciated that the different types of devices respond differently to the selected duty ratio applied and therefore provide different levels of brightness when the variable resistor is adjusted. Analog circuits are described in the patent which modify the duty ratio applied to the VFD, as compared to that which is supplied to the filament lamps, and further modify the duty ratio that is applied to the LED, as compared to that which is applied to the VFD.

U.S. Pat. No. 4,704,560 describes a digital power supply for a VFD. In that system, a microprocessor contains a look-up table of stored codes that correspond to predetermined grid and anode voltages and is used in conjunction with a digital pulse width modulator circuit to supply the appropriate display voltage to an associated VFD device. The described circuit is said to provide automatic compensation of pulse width modulation to the VFD based upon loading effects of other energized segments within the display. The microprocessor uses the look-up table to supply coded values to the digital pulse width modulator circuit when loading changes occur due to changes in the number of preselected anode segments.

SUMMARY OF THE PRESENT INVENTION

The present invention is directed to an electronic dimmer control circuit and method for supplying a dimmer signal to a VFD driver circuit. The dimmer signal is selected through a single sequential step-through comparison technique whenever a dimmer control rheostat is changed by an operator desiring a different light output brightness level. An adjustable rheostat serves to supply variable DC voltage to various filament lamps that are used in association with the VFD device. That same variable voltage is fed to a circuit which provides first and second adjustable DC dimmer voltages that are within the range of adjustment of the rheostat, and are offset by a predetermined constant difference with respect to each other. A dual comparator circuit utilizes the first and second adjustable DC dimmer voltage values as comparative upper and lower reference values and the constant offset voltage difference to define a "window" in which to sense when a selected voltage level is within or outside the defined window. The dual comparator circuit provides a first logic output signal when the selected voltage level is found to be outside the defined window and a second logic signal when it is within the window. A microprocessor senses the logic condition of the dual comparator. It is programmed to respond to the first logic signal output from the dual comparator by outputting predetermined digitally coded data. The digitally coded data from the microprocessor correspond to preselected and discrete analog DC voltage levels. The data are supplied to a digital to analog (D/A) converter which responsively outputs the corresponding selected DC voltage levels to the dual comparator. The microprocessor sequentially provides the digital output data that correspondingly steps through the preselected and discrete voltage levels. This continues until such time as the selected voltage level output from the D/A converter causes the dual comparator circuit to output a second logic level signal, which indicates the selected voltage level falls within the window defined by the first and second adjustable DC dimmer voltages. The occurrence of a second logic level signal to the microprocessor allows the digital output obtained from the microprocessor to be latched so that the D/A converter will continue to output the correspondingly selected voltage level to the comparator. The microprocessor then supplies a second corresponding digital value, selected from its look-up table, to a display driver circuit that will convert the value to a predetermined pulse width modulation duty cycle that is supplied to the energized segments of the VFD. In this manner, the microprocessor is required to step through the sequentially selected voltage values only once, whenever the dimmer control rheostat is adjusted. Such a system is highly desired in automobile radios and other systems where the continuous presence of stepping voltages may cause static and other interference to be produced in sensitive receiver circuits. In addition, the programming of values in the look-up table can be selected so that various sized VFDs can be employed and brightness levels can be coordinated with the DC brightness levels produced by filament lamps that may be in the same display panel.

DETAILED DESCRIPTION OF THE PREFERRED EMBODIMENT

Figure 1:
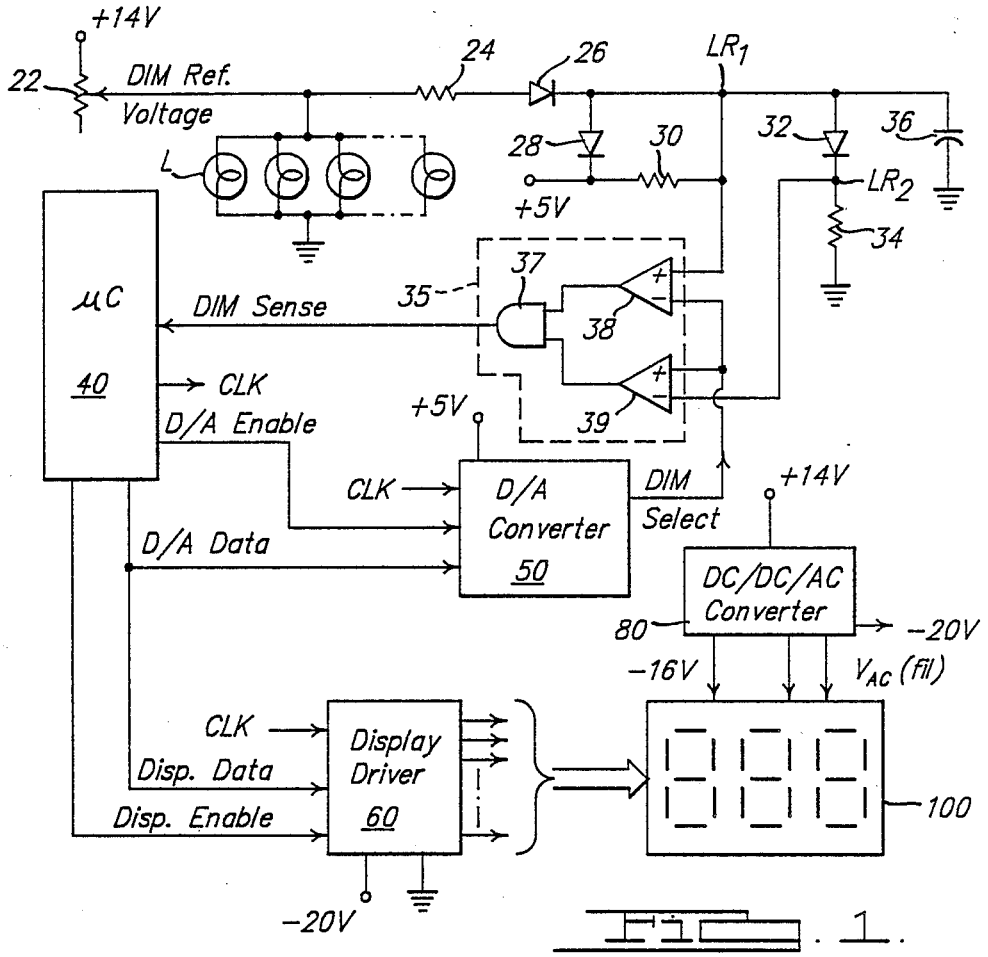
FIG. 1 is a schematic/block diagram of the preferred embodiment of the present invention.

In FIG. 1, a rheostat 22 is shown as connected between a 14 volt DC power source, such as would be conventionally found in an automotive vehicle, and filament lamp load L to ground. The rheostat 22 is, in this case, manually adjustable and used to supply a variable dimmer DIM Ref. voltage to instrument panel filament lamp loads L. The lamps L are therefore energized to the intensity levels desired to be viewed by the vehicle operator during nighttime conditions.

For corresponding control of the brightness level of an associated VFD, the adjustable DIM Ref. voltage is also dropped across a first divider resistor 24, a blocking diode 26, a window diode 32, and a second divider resistor 34 to ground. Blocking diode 26 serves to block negative transients. A capacitor 36 acts in conjunction with first divider resistor 24 and blocking diode 26 to provide a noise filter in the event noise voltages are present on the DIM Ref. voltage.

A dual comparator circuit 35 includes a comparator circuit 38, a comparator circuit 39, and an AND gate 37. Each comparator circuit 38 and 39 has positive (non-inverting) and negative (inverting) input terminals.

Comparator 38 has its positive input terminal connected to the junction between blocking diode 26 and window diode 32 to receive a first adjustable DC dimmer voltage as a reference level $LR_1$.

Comparator 39 has its negative input terminal connected to the junction between window diode 32 and second divider resistor 34 to receive a second adjustable DC dimmer voltage reference level $LR_2$ that is offset from the first adjustable DC dimmer voltage reference $LR_1$ by the substantially constant forward voltage drop across the window diode 32 (approximately 0.6 volts). Therefore, the first and second adjustable DC dimmer voltages $LR_1$ and $LR_2$ are constantly separated by a voltage difference value that defines a "window" equal to the forward voltage drop across window diode 32.

While the DIM Ref. voltage ranges from approximately 0 to 14 volts, the first adjustable DC dimmer voltage $LR_1$ is clamped at an upper level of approximately 5.6 volts by a diode 28, which has its anode connected to the junction between blocking diode 26 and window diode 32, and has its cathode connected to a 5 volt supply. A resistor 30 is connected between the 5 volt power supply and the junction between blocking diode 26 and clamping diode 32 to provide a lower limit of adjustability on $LR_1$ and $LR_2$. When rheostat 22 is set to 0 volts, the voltage drop across resistor 30, clamping diode 32 and second divider resistor 34 is such that $LR_2$ is held above 0 volts. And $LR_1$ is maintained at a voltage level higher than $LR_2$, by the forward voltage drop across window diode 32, so as to preserve the window within which the lowest possible selected DC voltage level can fit. The blocking diode 26 serves to isolate the $LR_1$ value from the loading effect of the path to ground through the lamps L. Therefore, the reference values $LR_1$ and $LR_2$ are adjustable within a predetermined range that corresponds to, but is less than, the adjustment range of the DIM Ref. voltage.

The dual comparator 35, which includes comparators 38 and 39, utilizes the values of $LR_1$ and $LR_2$ as reference levels with which to compare the incoming DIM Select voltage supplied by a D/A converter 50. The DIM Select voltage level output from the D/A converter 50 is a DC analog signal that is input to both the negative terminal of comparator 38 and the positive terminal of comparator 39. The outputs of the individual comparators to AND gate 37 are such that comparator 38 produces a high level output when the DIM Select voltage is lower than $LR_1$ and outputs a low level signal when the DIM Select voltage is greater than $LR_1$. Comparator 39 outputs a high level output when the DIM Select voltage is greater than $LR_2$ and outputs a low level signal when the DIM Select voltage is lower than $LR_2$. In the event the dual comparator 35 determines that the DIM Select signal is within the window defined by the offset between $LR_1$ and $LR_2$, both comparators 38 and 39 provide high level outputs to AND gate 37. The AND gate 37 provides a high logic level signal on the DIM Sense line only when the output of both comparator circuits 38 and 39 are high. Otherwise the AND gate 37 provides a low logic level signal on the DIM Sense line.

A microcomputer 40 functions to monitor the condition on the DIM Sense line and to commence a counting subroutine whenever the DIM Sense line is held to a low logic level. The microcomputer 40 provides a digital D/A Data code to the D/A converter 50 in conjunction with a D/A Enable pulse. The D/A converter 50 interprets the D/A Data code as a particular DC voltage that it supplies on the DIM Select line. If the logic level on the DIM Sense line remains at a low level at the end of a predetermined time period, the microcomputer 40 decrements the D/A Data code so that the D/A converter 50 will supply a lower selected value of DC voltage level on the DIM Select line. The above process is repeated to continue the search for the value of DIM Select voltage which is within the window defined by $LR_1$ and $LR_2$. At such time that a DIM Select signal is detected by the dual comparator circuit as being within the window between $LR_1$ and $LR_2$, the DIM Sense line is changed to a high logic level. In response to the high logic level on the DIM Sense line, the D/A Data code is latched and the selected DC level output by the D/A comparator 50 on the DIM Select line is also latched to maintain the output of the dual comparator circuit 35 at a high logic level.

The microcomputer 40 also supplies digital (brightness) Display data to a display driver 60 which sets the pulse width modulation duty cycle for the VFD 100. The Display data to the display driver 60 is coordinated with a signal placed on the Display Enable line so that it may be multiplexed to the display driver 60 along with the other data. The combined data to the display driver 60 determines which segments of the display are to be energized and how the display should be pulse width modulated (duty cycle) to provide an intensity output from the display 100 that has been predetermined as corresponding to the set intensity of lamps L.

The level of display brightness dictated by the Display data supplied to the displaY driver 60 is provided by the microcomputer 40 from its look-up table of stored values. The value obtained from the look-up table is a function of the D/A Data supPlied to the D/A converter 50 at the time the output of the dual comparator circuit 35 provides a high level logic signal on the DIM Sense line. In that manner, the display 100 will continue to be pulse width modulated at a given duty cycle until such time as the DIM Ref. voltage is changed.

A DC/DC/AC converter 80 is indicated as receiving the 14 volt supply voltage and converting it to regulated DC values of −16 volts, −20 volts and an AC filament voltage for the indicated components. The 5 volt level is supplied from other regulated voltage supplies (not shown). The 14 volt supply represents the vehicle battery (alternator) voltage.

Figure 2:
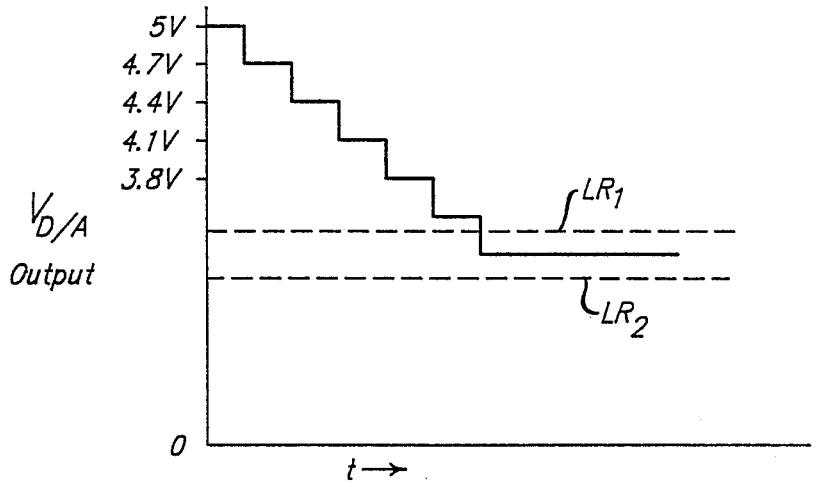
FIG. 2 is a waveform diagram illustrating the selected discrete voltage levels and the first and second adjustable DC dimmer voltage reference levels.

The following description of the operation of the circuit shown in FIG. 1 is made in conjunction with the waveform diagram shown in FIG. 2.

Upon adjustment of rheostat 22 to change the intensity level of the filament lamps L and the VFD 100, the reference levels $LR_1$ and $LR_2$ are changed and exemplified in FIG. 2 as dashed lines within a predetermined range of voltages. If the change of rheostat 22 causes either comparator 38 or 39 to change from outputting a high logic level to a low logic level signal, the AND gate will output a low logic level on the DIM Sense line. The microprocessor 40 will sense the change on the DIM Sense line and provide a predetermined digitally coded signal on the D/A Data line. When the D/A Enable line is toggled by the microcomputer 40, the D/A converter 50 reads the digital code signal and outputs a selected discrete DC voltage level (in this case 5 volts) on the DIM Select line. If no change from the low logic level is detected on the DIM Sense line within a prescribed time period, the microcomputer 40 decrements the digitally coded data supplied on the D/A Data line. The D/A converter 50 responsively outputs a selected discrete voltage level that is 0.3 volts less than the previous level in a step down fashion on the DIM Select line.

As shown in FIG. 2, when the voltage $V_{D/A}$ from the D/A converter 50 on the DIM Select line reaches a value that is both less than $LR_1$ and greater than $LR_2$ the dual comparator circuit 35 will provide a high logic level signal on the DIM Sense line. The microcomputer 40 will then latch the D/A Data line with the digitally coded data then present, and provide corresponding digital dimmer code data from its look-up table to the display driver 60, as indicated above.

In this fashion, the microcomputer 40 may be programmed with appropriate codes in the look-up table so that the pulse width modulation setting for driving the display 100 will simulate the intensity levels provided by the lamps at discrete levels that are visually acceptable as corresponding. Of course, the greater the number of steps the more accurate the degree of correspondence will be.

As can be seen from FIG. 2, the voltage range of the window defined between $LR_1$ and $LR_2$ is greater than any individual step between selected discrete voltage levels output from the D/A converter 50 on the DIM Sense line. That relationship insures that all points of adjustment of the rheostat 22 will result in the provision of a window between $LR_1$ and $LR_2$ in which a particular step level of the selected discrete voltage levels will be detected. Otherwise, if steps were larger than the defined window range, an adjustment setting of rheostat 22 could result in a window being positioned between discrete selected voltage levels and the series of steps would be continually sequenced from the upper limit to the lower limit, without the dual comparator circuit 35 detecting any selected voltage level as being within the window.

It will be apparent that many modifications and variations may be implemented without departing from the scope of the novel concept of this invention. Therefore, it is intended by the appended claims to cover all such modifications and variations which fall within the true spirit and scope of the invention.

I claim:

1. An electronic dimmer control circuit for supplying a dimmer signal to a vacuum fluorescent display driver circuit comprising:

means for supplying a first adjustable DC dimmer voltage having a value within a predetermined range and a second adjustable DC dimmer voltage that is below said first adjustable dimmer voltage by a constant predetermined amount;

comparator means for comparing the first and second DC voltages with a selected voltage level and outputting a first logic level signal when said selected voltage level has a value that is above said first adjustable DC dimmer voltage and when said selected voltage level has a value that is below said second adjustable DC dimmer voltage, and outputting a second logic level signal when said selected voltage level has a value that is between said first and second adjustable DC dimmer voltages;

means responsive to said first logic level signal output from said comparator means for stepping through a predetermined set of selected voltage levels and outputting each selected voltage level to said comparator means, responsive to said second logic level output from said comparator means to continue outputting the voltage level selected at the time said comparator means is switched to said second logic level, and outputting to said display driver circuit a dimmer signal that corresponds to said selected voltage level output to said comparator while said comparator is outputting said second logic level.

2. A circuit as in claim 1, wherein said responsive means includes a microprocessor means that is programmed to sequentially output an ordered set of digital codes whenever said comparator means switches from outputting said second logic signal to said first logic signal, and also includes means for converting each digital code as it is output from said microprocessor means to a predetermined one of said selected voltage levels, wherein said microprocessor means latches its output to that digital code being output when said comparator means switches to outputting said second logic signal.

3. A circuit as in claim 2, wherein said microprocessor means is also programmed to output said dimmer signal in the form of a digital dimmer code to said display driver circuit, wherein said digital dimmer code has a predetermined correspondence to said digital code of said sequence that becomes latched in response to the second logic signal output from said comparator means.

4. A circuit as in claim 1, wherein said selected voltage levels begin at the highest selected level and said responsive means steps to progressively lower levels that are separated by no more than a predetermined amount that is less than the constant difference between the first and second adjustable D.C. dimmer voltages.

5. A circuit as in claim 1, wherein said supplying means includes a rheostat that is manually adjustable to provide the source for said first and second adjustable D.C. dimmer voltages.

6. A circuit as in claim 5, wherein said supplying means includes a diode element and said first and second adjustable D.C. dimmer voltages are constantly separated by the value of the voltage drop across the forward conduction path of said diode element.

7. A circuit as in claim 6, wherein said diode element is in a series circuit formed between said rheostat and ground.

8. A circuit as in claim 1, wherein said supplying means includes a diode element and said first and second adjustable D.C. dimmer voltages are constantly separated by the value of the voltage drop across the forward conduction path of a diode element.

9. A method of providing a dimmer signal to a vacuum fluorescent display driver circuit comprising the steps of:

supplying a first adjustable DC dimmer voltage having a value within a predetermined range and a second adjustable DC dimmer voltage that is below said first adjustable dimmer voltage by a constant predetermined amount;

comparing the first and second DC voltages with a selected voltage level and providing a first logic level signal when said selected voltage level has a value that is above said first adjustable DC dimmer voltage and when said selected voltage level has a value that is below said second adjustable DC dimmer voltage, and providing a second logic level signal when said selected voltage level has a value that is between said first and second adjustable DC dimmer voltages;

responding to said first logic level signal provided by said comparing step by stepping through a predetermined set of selected voltage levels and providing each selected voltage level for each comparing step, responding to said second logic level provided by said comparing step by continuing to provide the voltage level selected at the time said comparing step provided said second logic level, and providing a dimmer signal to said display driver circuit that corresponds to said selected voltage level provided while said comparing step provides said second logic level.

10. A method as in claim 9, wherein said step of responding utilizes a microprocessor means that is programmed to sequentially output an ordered set of digital codes whenever said step of comparing provides said first logic signal, and also includes means for converting each digital code output from said microprocessor means to a predetermined one of said selected voltage levels, wherein said microprocessor means latches its output to that digital code selected when said step of comparing provides said second logic signal.

11. A method as in claim 10, wherein said microprocessor means is also programmed to output said dimmer signal in the form of a digital dimmer code to said display driver circuit, wherein said digital dimmer code has a predetermined correspondence to said digital code of said sequence that becomes latched in response to the second logic signal provided by said step of comparing.

12. A method as in claim 9, wherein said step of responding commences with a said selected voltage level at the highest selected level and sequentially steps to progressively lower levels that are separated by no more than a predetermined amount that is less than the constant difference between the first and second adjustable D.C. dimmer voltages.

* * * * *